US005913584A

United States Patent [19]

Swindell et al.

[11] Patent Number: 5,913,584

[45] Date of Patent: Jun. 22, 1999

[54] ADJUSTABLE REFRIGERATOR SHELF

[75] Inventors: Thomas R. Swindell, Greenville; Curtis W. Sisson, Sheridan, both of Mich.; Daniel James Ocharzak, Columbus, Ohio

[73] Assignee: White Consolidated Industries, Inc., Cleveland, Ohio

[21] Appl. No.: 08/936,004

[22] Filed: Sep. 23, 1997

[51] Int. Cl.[6] ..... A47B 57/00

[52] U.S. Cl. ..... 312/408; 312/306; 312/350; 108/108; 211/187; 248/292.12

[58] Field of Search ..... 312/126, 128, 312/404, 408, 312, 410, 306, 350, 351, 247; 108/106, 107, 108, 147, 147.11, 147.17; 211/90.02, 187, 208; 248/244, 241, 292.12, 295.11

[56] References Cited

U.S. PATENT DOCUMENTS

| | | | |
|---|---|---|---|
| 2,054,327 | 9/1936 | Jeck . | |
| 2,178,815 | 11/1939 | Shuart . | |
| 2,284,339 | 5/1942 | Nauert . | |
| 2,306,266 | 12/1942 | Heim . | |
| 2,609,267 | 9/1952 | Hallock . | |
| 2,836,305 | 5/1958 | Davey et al. . | |
| 2,841,459 | 7/1958 | Sharpe . | |
| 2,861,857 | 11/1958 | Lee et al. . | |
| 2,932,404 | 4/1960 | Vershbow . | |
| 2,998,290 | 8/1961 | Sharpe . | |
| 3,096,885 | 7/1963 | Peters . | |
| 3,185,116 | 5/1965 | Gilbert . | |
| 3,220,364 | 11/1965 | Sandin . | |
| 3,316,044 | 4/1967 | Carbary . | |
| 3,360,322 | 12/1967 | Hanifan . | |
| 3,550,891 | 12/1970 | Scott | 108/108 X |
| 3,734,589 | 5/1973 | Morgan . | |
| 3,768,883 | 10/1973 | Kauffman . | |
| 3,885,846 | 5/1975 | Chuang et al. . | |
| 3,982,801 | 9/1976 | Heidorn et al. . | |
| 4,217,010 | 8/1980 | Webb . | |
| 4,515,086 | 5/1985 | Kwiecinski et al. . | |
| 4,619,208 | 10/1986 | Kurrasch | 108/106 X |
| 4,948,207 | 8/1990 | Rolls et al. . | |
| 5,199,778 | 4/1993 | Aoki et al. . | |
| 5,226,707 | 7/1993 | Han et al. | 312/408 |
| 5,303,997 | 4/1994 | Kropf . | |

*Primary Examiner*—Peter M. Cuomo
*Assistant Examiner*—Janet M. Wilkins
*Attorney, Agent, or Firm*—Pearne, Gordon, McCoy & Granger LLP

[57] ABSTRACT

A vertically adjustable shelf for a refrigerator includes a mounting assembly which cooperates with a pair of vertically extending tracks to position the adjustable shelf at a plurality of predetermined positions, a support assembly is carried by the mounting assembly and movable relative to the mounting assembly so that the support assembly can be positioned at each position between the plurality of predetermined positions, and an encapsulated shelf carried by the support assembly. The mounting assembly has a pair of vertical rack gears and a pair of track mounting brackets which engage the tracks. The support assembly includes a knob centrally located at a forward end of the shelf and a gear box connecting the knob with the rack gears so that the support assembly moves relative to the mounting assembly when the knob is turned.

19 Claims, 5 Drawing Sheets

32
76
68
78
44
62
80
88
84
82
86
34
72
74
90
70

ADJUSTABLE REFRIGERATOR SHELF

BACKGROUND OF THE INVENTION

The present invention generally relates to refrigerators and, more specifically vertically adjustable storage systems for refrigerators.

A typical refrigeration apparatus, such as a refrigerator/freezer, includes one or more refrigerated compartments. A plurality of storage systems, such as shelves and/or pans, are mounted within the compartments for storing items to be refrigerated. The storage systems can be stationary or selectively positionable within the compartments. Commonly, shelves are cantilevered from tracks mounted at the rear of the compartment so that they can be moved between a fixed number of predetermined vertical positions along the tracks.

The spacing above each shelf must be sufficient to allow items of various sizes to be placed thereon without interference. Occasionally, therefore, the shelves must be repositioned to a different height. When the shelves are cantilevered from tracks, however, all of the items must be removed from the shelf before the shelf can be removed from the track and remounted at the new position. Additionally, the shelves can only be located at the fixed number predetermined positions. The locations of the shelves, therefore, may not allow optimal usage of the storage space within the compartment.

U.S. Pat. No. 5,199,778 discloses one attempt to solve these problems. Gear racks are mounted to the rear of the compartment which extend the full height of the compartment. Shelves are provided with gear assemblies which engage the racks to vertically move the shelves within the compartment when the gears are rotated. Either a dial or an electric motor rotates the gears. This approach, however, is relatively expensive to produce and cannot be utilized with existing refrigerator cabinets.

Accordingly, there is a need in the art for an adjustable storage system which is quick and easy to adjust, is infinitely adjustable, is relatively inexpensive to produce, and can be utilized with existing cabinets and mounting tracks.

BRIEF SUMMARY OF THE INVENTION

The present invention provides a vertically-adjustable storage system which overcomes at least some of the above-noted problems of the related art. According to the invention, the vertically-adjustable storage system includes a mounting assembly removably mounted to a rear wall of a refrigeration apparatus and vertically movable to a plurality of predetermined positions along the rear wall, a support assembly carried by the mounting assembly and vertically movable relative to the mounting assembly, and a storage accessory carried by the support assembly.

According to one aspect of the present invention, the refrigeration apparatus preferably has a pair of vertically extending and laterally spaced-apart tracks at the rear wall and the mounting assembly has a pair of mounting brackets with hooks for engaging the tracks. According to another aspect of the invention, the mounting assembly includes a pair of vertical rack gears and the support assembly includes a knob centrally located at a forward end of the support assembly and a gear box connecting the knob with the rack gears so that the support assembly vertically moves relative to the mounting assembly when the knob is turned. The gear box preferably includes a drive gear with a longitudinally extending axis of rotation, a driven gear with a laterally extending axis of rotation and engaging the drive gear, a gear shaft secured to the driven gear for rotation therewith, a pair of spur gears secured to opposite ends of the gear shaft for rotation therewith and engaging the rack gears.

BRIEF DESCRIPTION OF THE SEVERAL VIEWS OF THE DRAWINGS

These and further features of the present invention will be apparent with reference to the following description and drawings, wherein.

DETAILED DESCRIPTION OF THE INVENTION

Figure 1:
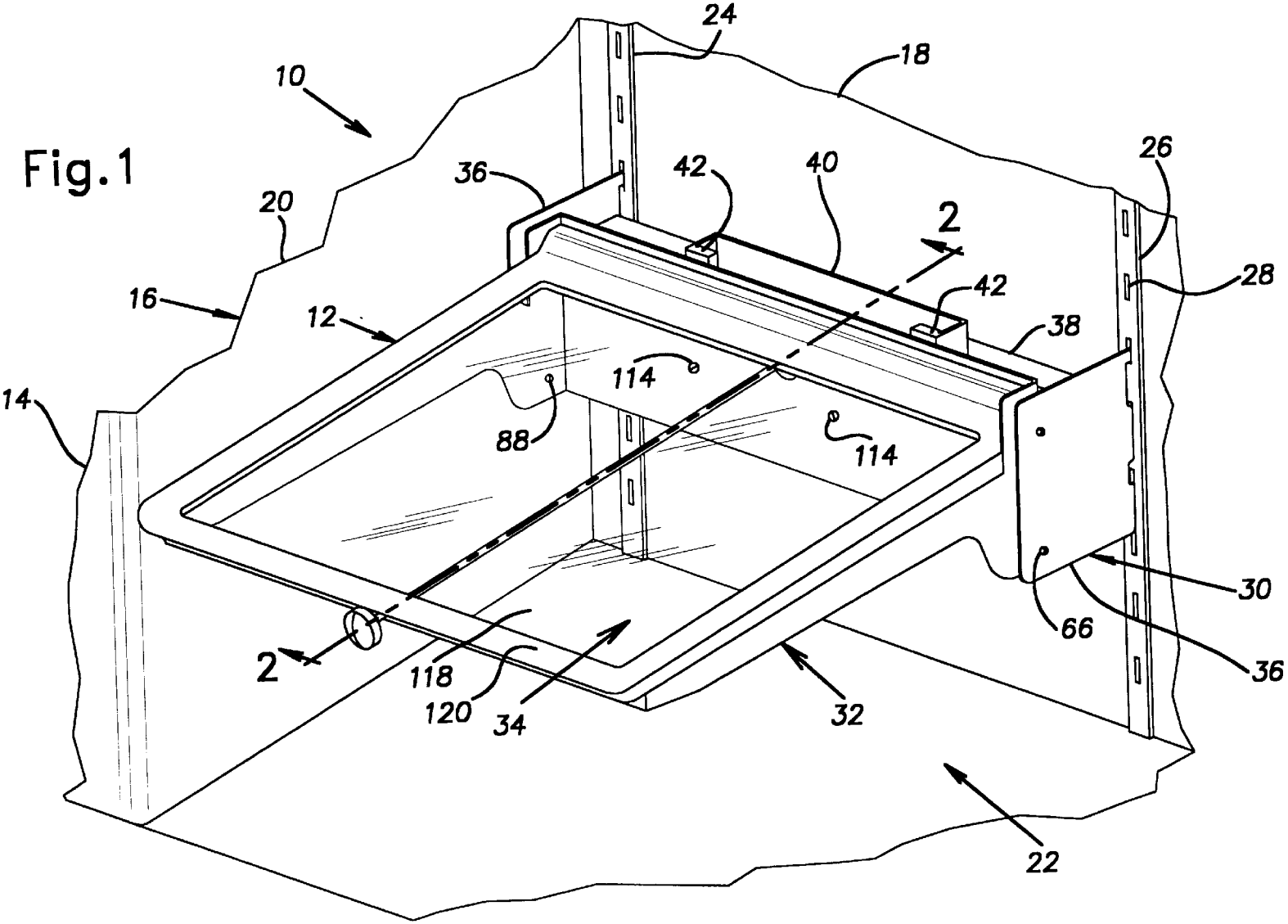
FIG. 1 is a perspective view of a portion of a refrigerator according to the present invention showing an adjustable refrigerator shelf.
Figure 2:
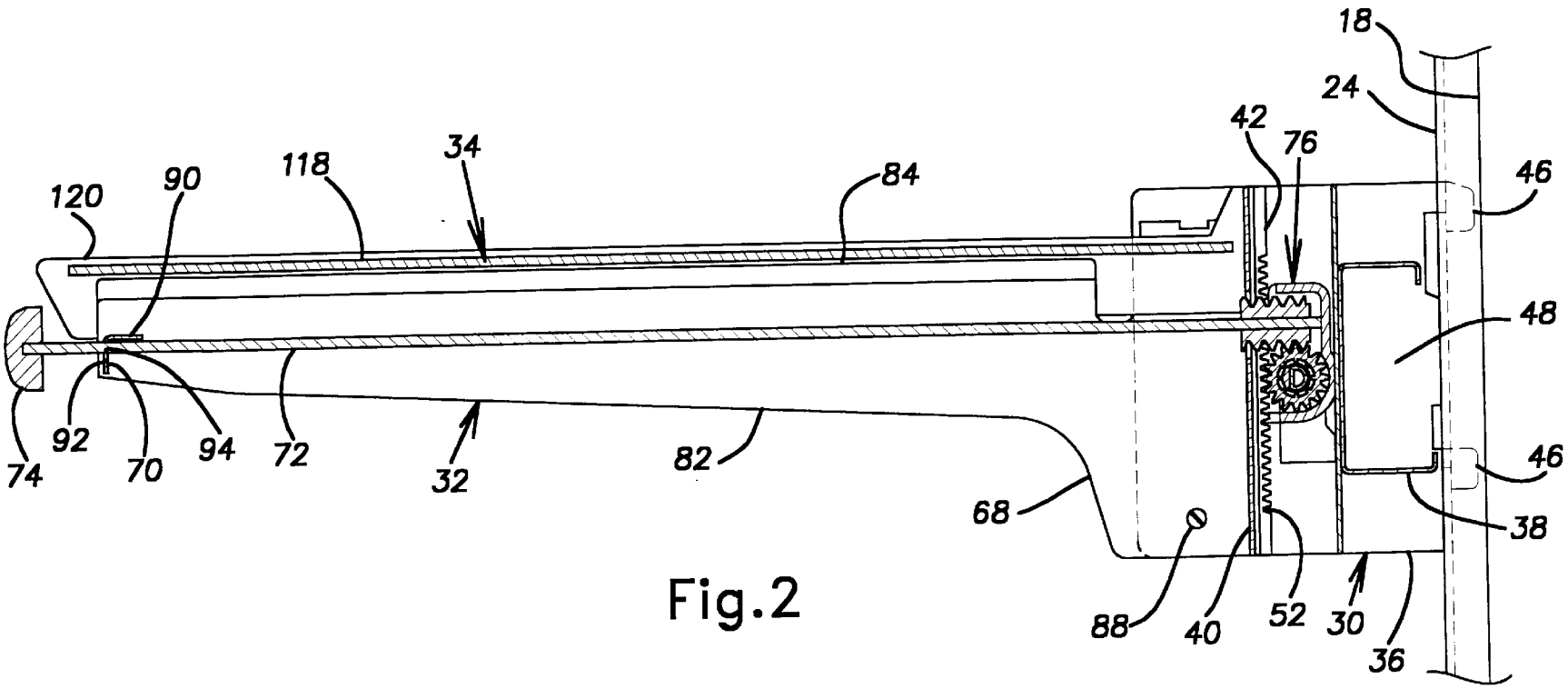
FIG. 2. is a elevational view, in cross-section, taken along line 2—2 of FIG. 1.

FIGS. 1 and 2 illustrate a refrigeration apparatus 10, such as a refrigerator/freezer, which includes a cantilevered, adjustable storage system or shelf 12 according to the present invention. The refrigeration apparatus 10 includes a cabinet 14 having an inner liner 16 with a rear wall 18 and opposite side walls 20. The inner liner 16 forms a fresh food or above-freezing compartment 22 which is refrigerated in a conventional manner. Access to the fresh food compartment 22 is provided through a fresh food door (not shown).

A pair of vertical ladders or tracks 24, 26 of conventional construction are mounted to the rear wall 18 of the inner liner 16. The vertical tracks 24, 26 are laterally spaced-apart for half-width shelves, with the first track 24 being positioned immediately adjacent one of the side walls 20 and the second track 26 being centrally located between the side walls 20. A third track (not shown) is located immediately adjacent the other one of the side walls 20 for positioning the adjustable shelf 12 on the other side of the compartment 22 or mounting a full width shelf. Although not specifically illustrated, the adjustable shelf 12 can be a full-width shelf within the scope of the present invention. Each track 24, 26 includes a plurality of longitudinally extending and longitudinally spaced-apart openings or slots 28. The tracks 24, 26 can be used to mount conventional cantilevered shelves at any one of a number of predetermined vertical heights within the compartment 22 which are defined by the slots 28. The tracks 24, 26 can also be used to position the shelf of the adjustable shelf 12 at an infinite number of vertical heights within the compartment 22 as described in more detail below.

Figure 3:
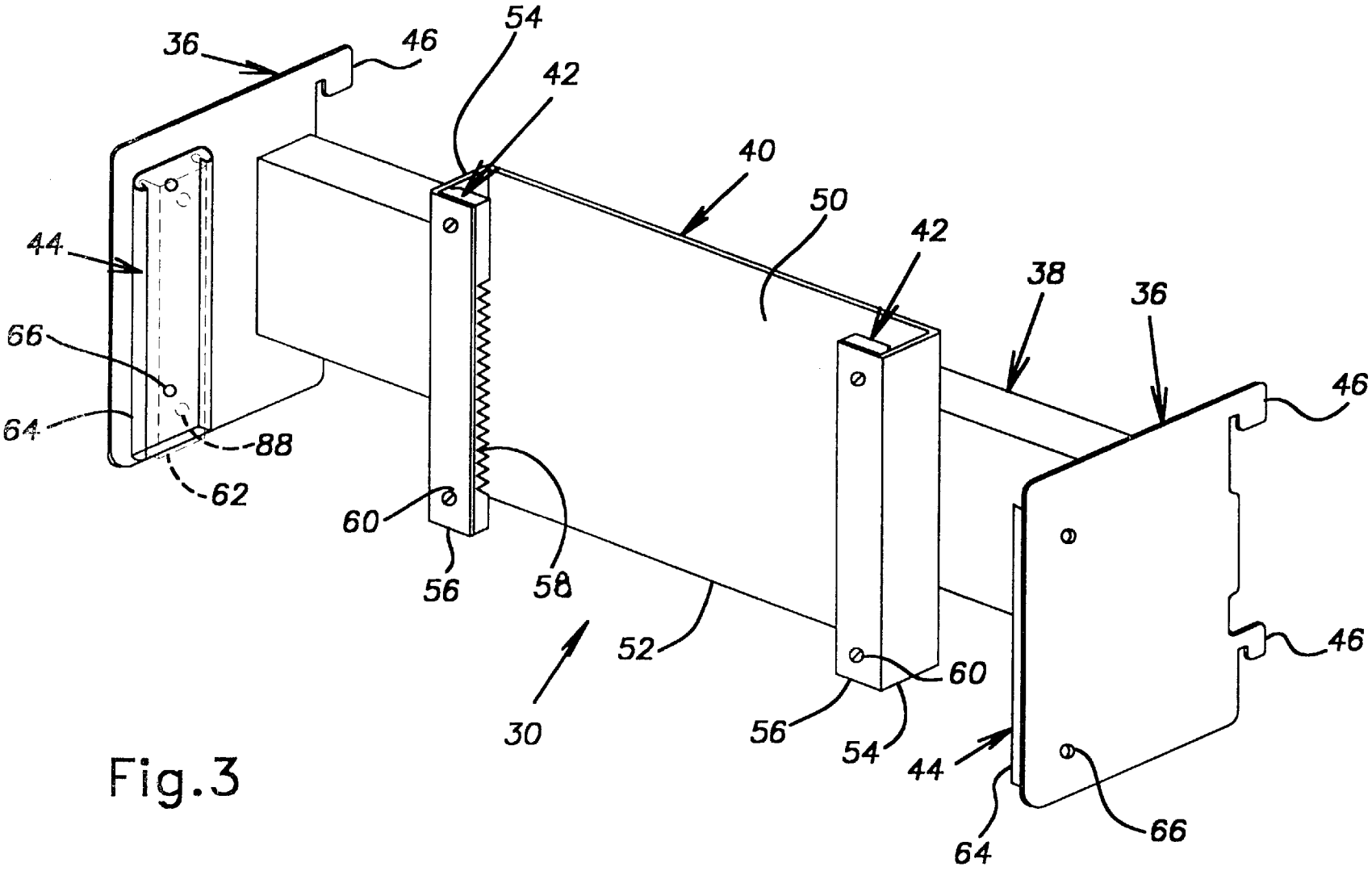
FIG. 3 is a front perspective view of a mounting bracket assembly of the adjustable refrigerator shelf of FIG. 1.

The adjustable shelf 12 includes a mounting assembly 30, a shelf support assembly 32, and a storage accessory such as an encapsulated shelf 34. As best shown in FIG. 3, the mounting assembly 30 includes a pair of track mounting brackets 36, a cross brace 38, a gear bracket 40, a pair of rack gears 42, and a pair guide assemblies 44. Each track mounting bracket 36 is planar and generally rectangularly shaped. The rear edge of each mounting bracket 36 has a pair of vertically spaced-apart hooks 46 which cooperate with the slots 28 of the tracks 24, 26.

The vertically oriented mounting brackets 36 are parallel and spaced apart by the cross brace 38. The cross brace 38 is secured to the mounting brackets 36 adjacent the rearward edge of each mounting bracket 36. Preferably, the mounting brackets 36 and the cross brace 38 are welded together. The cross brace 38 spaces-apart the mounting brackets 36 a distance which corresponds to the spacing of the tracks 24, 36. The cross brace 38 is preferably C-shaped in cross-section, defining a horizontally extending and rearwardly opening channel 48 (best shown in FIG. 2).

The gear bracket 40 is generally C-shaped in cross-section, defining a vertically extending and frontwardly opening channel 50. Specifically, the gear bracket 40 has a vertically oriented and laterally extending main or rear wall 52, a pair of vertically oriented side walls 54 forwardly extending from the ends of the rear wall 52, and a pair of vertically oriented flanges or lips 56 laterally and inwardly extending from the forward end of the side walls 54. The gear bracket 40 is secured to the forward side of the cross brace 38, centrally between the mounting brackets 36. Preferably, the gear bracket 40 and the cross brace 38 are welded together.

The rack gears 42 each include a plurality of vertically spaced apart and laterally extending teeth 58. Each of the rack gears 42 is secured to a rear side of an associated one of the lips 56 so that the rack gears 42 are laterally spaced-apart. Mounted in this manner, each of the rack gears 42 are rearwardly facing and spaced apart from the forward side of the gear bracket rear wall 52. The rack gears 42 are preferably secured to the gear bracket 40 with fasteners 60 such as, for example, screws or rivets.

The guide assemblies 44 each include inner and outer members 62, 64 which interlock in a manner which allows longitudinal sliding movement therebetween but limits and generally prevents relative movement in other directions. The guide assemblies 44 are preferably drawer glides. Each outer member 64 is vertically extending and secured to an inner side of an associated one of the mounting brackets 36 so that the outer members 64 are laterally spaced-apart and facing one another. The outer members 64 are preferably secured to the mounting brackets 36 with fasteners 66 such as, for example, screws or rivets. The inner members 62 are secured to the shelf support assembly 32 as described in more detail hereafter. The inner and outer members 62, 64 of the illustrated guide assemblies 44 are shown separated for clarity in the various figures. The inner and outer members 62, 64 of the guide assemblies 44, however, are preferably not separable so that the guide assemblies 44 hold or secure the mounting bracket assembly 30 and the shelf support assembly 32 together.

Figure 4:
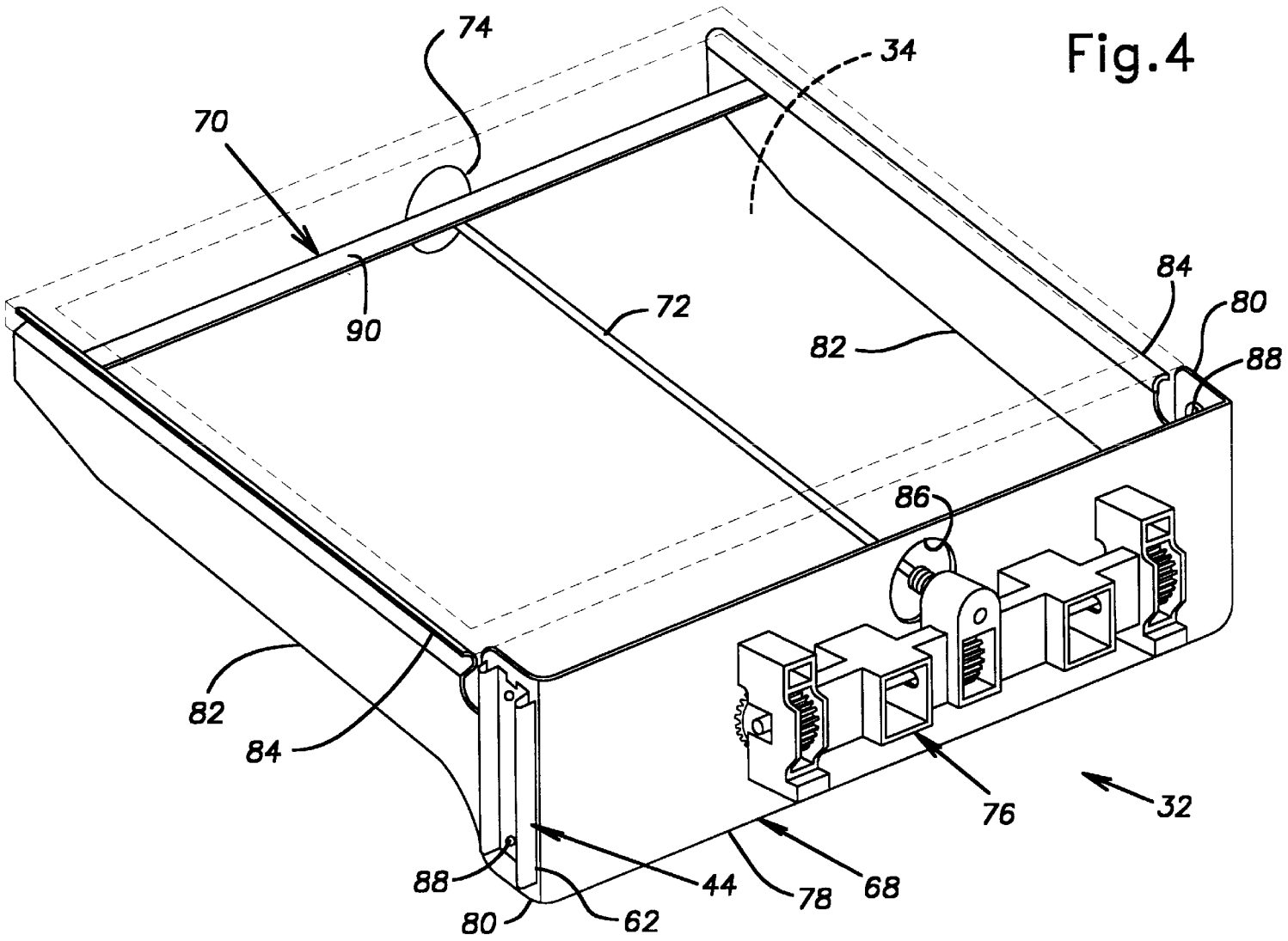
FIG. 4 is a rear perspective view of a shelf assembly of the adjustable refrigerator shelf of FIG. 1.

As best shown in FIG. 4, the shelf support assembly 32 includes a shelf support 68, a cross member 70, a shaft or rod 72, an adjusting knob 74, and a gear box 76. The shelf support 68 has a vertically oriented and laterally extending main or rear wall 78, a pair of vertically oriented base or side walls 80 forwardly extending from the ends of the rear wall 78, and a pair of vertically oriented side arms 82 forwardly extending from the side walls 80. The upper edge of each side arm 82 is bent to form a flange 84 for the encapsulated shelf 34 as will be described in more detail hereafter. The side arms 82 are mirror images of one another and are spaced-apart a distance which corresponds to the spacing of the mounting brackets 36 of the mounting bracket assembly 30. Preferably, the shelf support 68 is formed from a continuous sheet of metal. A centrally located circular opening 86 is provided in the rear wall 78 for the rod 72.

Each of the inner members 62 of the guide assemblies 44 is vertically extending and secured to an outer side of an associated one of the side walls 80 so that the inner members 62 are laterally spaced-apart and facing in opposite directions. The inner members 62 are preferably secured to the shelf support 68 with fasteners 88 such as, for example, screws or rivets. Note that the side walls 80 of the shelf support 68 are spaced-apart a distance which allows the guide assemblies 44 to connect the mounting brackets 36 to the side wall 80 of the shelf support 68.

The cross member 70 laterally extends between and is secured to the side arms 82 of the shelf support 68 adjacent the forward end of the shelf support assembly 32. Preferably, the shelf support 68 and the cross member 70 are welded together. The cross brace 70 is preferably angle-shaped in cross-section, having a horizontally oriented top wall 90 and vertically oriented front wall 92 downwardly extending from a forward edge of the top wall 90 (best shown in FIG. 2). The front wall 92 is provided with a centrally located circular opening 94 for the rod 72.

The rigid, straight rod 72 extends from the opening 94 in the cross member 70 to the opening 86 in the shelf support 68. The forward end of the rod 72 is rigidly secured to the adjusting knob 74 so that the rod 72 rotates with the adjusting knob 74 when the adjusting knob 74 is turned. The adjusting knob 74 is located at the forward end of the shelf support assembly 32 centrally between the side arms 82 of the shelf support 68 and in front of the cross member 70. The rear end of the rod 72 is connected to the gear box 76 as described in more detail hereafter. The rod 72 is rotatingly supported and journaled by the cross member 70 and the gear box 76.

Figure 5:
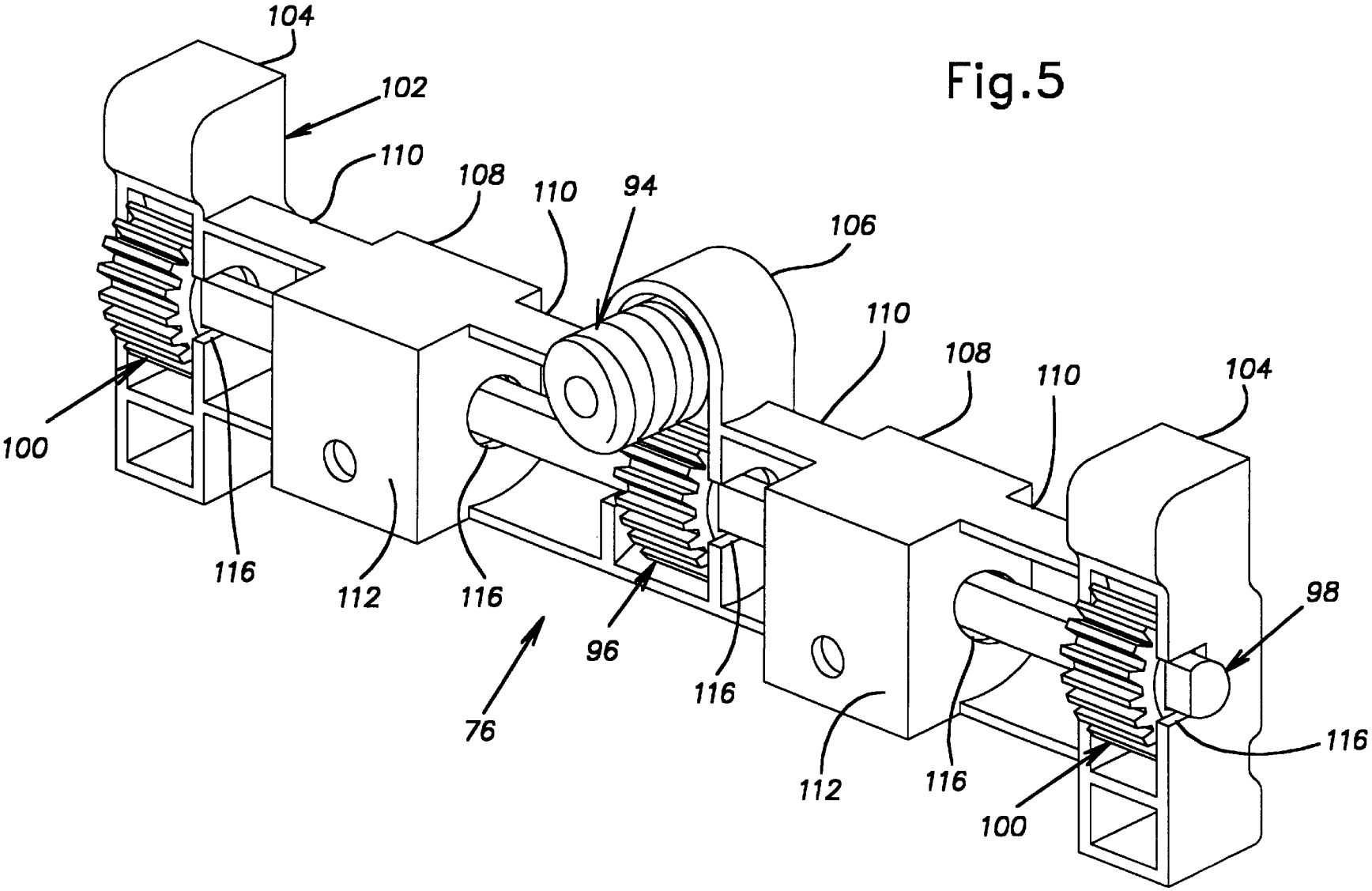
FIG. 5 is an enlarged front perspective view of a gear box assembly of the shelf assembly of FIG. 4.

As best shown in FIG. 5, the gear box 76 includes a drive gear 94, a driven gear 96, a "D"-shaped rod or gear shaft 98, a pair of spur gears 100, and a box or housing 102. The drive gear 94 is a horizontally extending worm gear having a generally screw-shaped tooth. The drive gear 94 is rigidly secured to the rear end of the rod 72 so that the drive gear 94 rotates with the rod 72 about the horizontally and longitudinally extending axis defined by the rod 72. The driven gear 96 is a spur gear located below the drive gear 94 and engaging the drive gear 94 so that the driven gear 96 rotates about a horizontally and laterally extending axis defined by the gear shaft 98 when the drive gear 94 rotates. Note that the gear shaft 98 is substantially perpendicular to the rod 72. The driven gear 96 can alternately be a worm wheel, that is, a gear having teeth at an angle the rotational axis. The driven gear 96 is rigidly secured to the center of the gear shaft 98 so that the gear shaft 98 rotates with the driven gear 96. The spur gears 100 are rigidly secured to the opposite ends of the gear shaft 98 so that the spur gears 100 rotate with the gear shaft 98. The spur gears 100 are spaced-apart a distance which coordinates with the spacing of the rack gears 42 of the mounting bracket assembly 30.

The driven gear 96 is engaged with the drive gear 94 in a manner so that it is dynamically easy to rotate the driven gear 96 by rotating the drive gear 94. On the other hand, an extremely large torque is required to rotate the drive gear 94 by rotating the driven gear 96 due to the tooth ratio between the gears 94, 96. Therefore, the gears 94, 96 act as a stop mechanism which prevents the weight of food items placed on the adjustable shelf 12 from lowering the adjustable shelf 12.

The housing 102 has end portions 104, a central portion 106, spacing portions, 108, and connecting portions 110. The end portions 104 are sized and shaped to generally surround the spur gears 100 except for a forward portion of the spur gears 100 which engage the rack gears 42. The central portion 106 is sized and shaped to generally surround the driven gear 96 and a rear portion of the drive gear 94. The spacing portions 108 are located between the central portion 106 and the end portions 104. The spacing portions are sized and shaped to space the gear box 76 from the shelf support 68 and have an engagement surface 112 at a forward side thereof. The engagement surface 112 engages the rearward side of the rear wall 78 of the shelf support 68 and is secured thereto to secure the gear box 76 to the shelf support 68. The spacing portions 108 are preferably secured to the shelf support rear wall 78 with fasteners 114 such as, for example, screws or rivets. The spacing portions 108 space the gear box 76 from the shelf support 68 so that the rack gears 42 of the mounting bracket assembly 30 can extend therebetween and engage the spur gears 100. The connecting portions 110 are sized and shaped to connect the other portions 104, 106, 108. The housing 102 is provided with suitable openings 116 for the gear shaft 98 which support and journal the gear shaft 98. Preferably, the housing 102 is molded of a suitable plastic material.

The mounting assembly 30 and the support assembly 32 are held together by the guide assemblies 44. The gear box 76 of the support assembly 32 vertically moves within the gear bracket 40 of the mounting assembly 30 with the spur gears 100 engaging the rack gears 42.

The encapsulated shelf 34 includes a generally planar shelf member 118 and a molded plastic rim 120. The shelf member 118 is preferably a light transmitting material such as, for example, optically clear tempered glass. The molded plastic rim 120 extends around the entire perimeter edge of the shelf member 118 as well as the flanges 84 of the shelf support side arms 82 to connect the shelf member 118 above the flanges 84. The flanges 84 provide a secure stable support for the shelf member 118. The rim 120 is preferably molded to extend above the top surface of the shelf member 118 and is preferably molded to form a dam which contains spills occurring on the shelf member 118. Additionally, a seal is preferably formed between the rim 120 and the shelf member 118 to prevent spills from leaking therethrough.

It is noted that although the shelf 34 of the illustrated embodiment is fixed to support assembly 32, the storage accessory can be slideably mounted to the support assembly 32 within the scope of the present invention. Additionally, the support assembly 32 can be used with a wide variety of different types of storage accessories such as, shelves, storage bins, storage pans, or any other suitable storage accessory for storing items to be refrigerated.

To vertically move or reposition the shelf 34, the centrally located knob 74 at the front of the shelf support assembly 32 is turned to raise or lower the shelf 34. Preferably, the total travel is about 3 inches, having about 1.5 inches upward travel and about 1.5 inches downward travel from a central position.

As the knob is turned, the rod 72 and drive gear 94 rotate therewith. The rotating drive gear 94 rotates the driven gear 96. The gear shaft 98 and the spur gears 100 rotate with the driven gear 96. The rotating spur gears 100 move along the fixed position rack gears 42 of the mounting bracket assembly 30 to raise or lower the shelf support assembly 32 and the encapsulated shelf 34. When the desired position is reached, rotation of the knob 74 is stopped and the shelf 34 remains in the desired position.

To vertically move or reposition the shelf 34 a distance greater than the travel of the adjustable shelf 12, the adjustable shelf 12 is removed from the tracks 24, 26 by removing the hooks 46 of the mounting bracket assembly 30 from the slots 28 of the tracks 24, 26. The adjustable shelf 12 is then reconnected to the tracks 24, 16 at a desired one of the predetermined heights defined by the slots 28 in the tracks 24, 26.

It can be seen from the above description that the adjustable shelf 12 provides quick and easy adjustment of storage space within the refrigerating apparatus 10 by simply turning the knob 74 which is conveniently located where it is easy to see and reach. Additionally, the adjustable shelf 12 provides infinite positioning of the shelf 34 because the adjustable shelf 12 can be located at any of the predetermined positions defined by the slots 28 of the tracks 24, 26 and the support assembly 32 can be moved relative to the mounting assembly 30 to position the shelf 34 at every position between each of the predetermined positions. Furthermore, the adjustable shelf 12 can be used in existing or new refrigerators because the adjustable shelf 12 mounts to the conventional tracks 24, 26.

Although particular embodiments of the invention have been described in detail, it will be understood that the invention is not limited correspondingly in scope, but includes all changes and modifications coming within the spirit and terms of the claims appended hereto.

What is claimed is:

1. A vertically-adjustable storage system for a refrigeration apparatus having vertically extending tracks, said storage system comprising:

a mounting assembly having a pair of track mounting brackets with hooks thereon;

a support assembly carried by said mounting assembly and vertically movable relative to said mounting assembly, wherein said support assembly is operably connected to said mounting assembly by at least one vertically extending rack gear and at least one spur gear engaging said rack gear so that said support assembly is vertically moved relative to said mounting assembly upon rotation of said spur gear; and a storage accessory carried by said support assembly.

2. The storage system according to claim 1, wherein said storage accessory is a shelf.

3. The storage system according to claim 1, wherein said mounting assembly includes said at least one vertically extending rack gear and said support assembly includes a knob and a gear box including said spur gear connecting said knob with said rack gear so that said support assembly is vertically moved relative to said mounting assembly upon rotation of said knob.

4. The storage system according to claim 3, wherein said knob is centrally located at a forward end of said storage accessory.

5. The storage system according to claim 1, wherein said mounting assembly includes a pair of said vertically extending rack gears which are laterally spaced-apart and said support assembly includes a gear box having a drive gear with a longitudinally extending axis of rotation, a driven gear with a laterally extending axis of rotation and engaging said drive gear, a gear shaft secured to said driven gear for rotation therewith, and a pair of said spur gears secured to opposite ends of said gear shaft for rotation therewith and engaging said rack gears.

6. The storage system according to claim 5, wherein said support assembly includes a knob centrally located at a forward end of said support assembly and connected to said drive gear for rotating said drive gear.

7. The storage system according to claim 1, wherein said mounting assembly and said support assembly are connected by guide assemblies which interlock in a manner allowing relative movement therebetween in a vertical direction but generally preventing relative movement in other directions.

8. A refrigeration apparatus comprising:

a liner having a rear wall partially defining a refrigerated compartment; and a vertically-adjustable storage system including:

a mounting assembly removably mounted to said rear wall and vertically movable to a plurality of predetermined positions along said rear wall;

a support assembly carried by said mounting assembly and vertically movable relative to said mounting assembly, wherein said support assembly is operably connected to said mounting assembly by at least one vertically extending rack gear and at least one spur gear engaging said rack gear; and a storage accessory carried by said support assembly.

9. The refrigeration apparatus according to claim 8, wherein said storage accessory is a shelf.

10. The refrigeration apparatus according to claim 8, wherein said mounting assembly includes said at least one vertically extending rack gear and said support assembly includes said at least one spur gear engaging said rack gear.

11. The refrigeration apparatus according to claim 10, wherein said support assembly includes a knob centrally located at a forward end of said support assembly and connected to said spur gear for rotating said spur gear.

12. The refrigeration apparatus according to claim 8, wherein said mounting assembly and said support assembly are connected by guide assemblies which interlock in a manner allowing relative movement therebetween in a vertical direction but generally preventing relative movement in other directions.

13. The refrigeration apparatus according to claim 8, wherein said mounting assembly includes a pair of said vertically extending rack gears which are laterally spaced-apart and said support assembly includes a gear box having a drive gear with a longitudinally extending axis of rotation, a driven gear with a laterally extending axis of rotation and engaging said drive gear, a gear shaft secured to said driven gear for rotation therewith, and a pair of said spur gears secured to opposite ends of said gear shaft for rotation therewith and engaging said rack gears.

14. The refrigeration apparatus according to claim 13, wherein said support assembly includes a knob connected to said drive gear for rotating said drive gear.

15. The refrigeration apparatus according to claim 14, wherein said knob is centrally located at a forward end of said support assembly.

16. The refrigeration apparatus according to claim 8, further comprising a pair of vertically extending and laterally spaced-apart tracks at said rear wall, wherein said mounting assembly has a pair of mounting brackets with hooks engaging said tracks.

17. An adjustable shelf for a refrigeration apparatus having a pair of vertically extending tracks, said adjustable shelf comprising:

a mounting assembly having a pair of vertically extending rack gears and a pair of track mounting brackets with hooks thereon;

a support assembly carried by said mounting assembly and vertically movable relative to said mounting assembly, said support assembly including a gear box having a drive gear with a longitudinally extending axis of rotation, a driven gear with a laterally extending axis of rotation and engaging said drive gear, a gear shaft secured to said driven gear for rotation therewith, a pair of spur gears secured to opposite ends of said gear shaft for rotation therewith and engaging said rack gears and a knob connected to said drive gear for rotating said drive gear; and a shelf carried by said support assembly.

18. The adjustable shelf according to claim 17, wherein said knob is centrally located at a forward end of said shelf.

19. The adjustable shelf according to claim 17, wherein said mounting assembly and said support assembly are connected by guide assemblies which interlock in a manner allowing relative movement therebetween in a vertical direction but generally preventing relative movement in other directions.

* * * * *